United States Patent [19]

Prough et al.

[11] Patent Number: 4,596,631

[45] Date of Patent: Jun. 24, 1986

[54] METHOD OF REMOVING LATENCY FROM MEDIUM CONSISTENCY PULPS BY PUMPING THE PULP

[75] Inventors: J. Robert Prough; Louis O. Torregrossa, both of Glens Falls, N.Y.; Åke Backlund, Karlstad, Sweden

[73] Assignee: Kamyr, Inc., Glens Falls, N.Y.

[21] Appl. No.: 608,191

[22] Filed: May 8, 1984

[51] Int. Cl.[4] ..... D21D 5/18; D21D 5/28

[52] U.S. Cl. ..... 162/52; 162/55; 162/57

[58] Field of Search ..... 162/52, 55, 20, 22, 162/23, 24, 25, 26, 28, 27, 19, 1, 57; 241/28; 55/21; 415/203, 204

[56] References Cited

U.S. PATENT DOCUMENTS 4,361,464 11/1982 Karnis ..... 162/49

4,435,163 3/1984 Gullichsen et al. ..... 55/21

OTHER PUBLICATIONS

Rydholm "Pulping Processes", Interscience Publishers; New York, 1967, pp. 392–395.

Dawson et al. article "A Rapid Method for Developing . . . ", Pulp and Paper of Canada, 1978, vol. 79, pp. 81–86.

"Noram" brochure, The Domtar Disintegrator, May 1, 1978.

Brochure of D. J. Murray Manufacturing Co., 1948, "Murray Pulp Stock Agitator".

*Primary Examiner*—Steve Alvo

*Attorney, Agent, or Firm*—Nixon & Vanderhye

[57] ABSTRACT

The latency of mechanical pulp is removed in a quick and simple manner. After refining of comminuted cellulosic material to produce mechanical pulp, the pulp is diluted (if necessary) to a consistency of between about 8–25%, and the pulp is then merely pumped to a further treatment stage. Pumping is effected utilizing a centrifugal pump which fluidizes the pulp, the fluidization imparting sufficient energy to the pulp to remove the latent properties. The pulp may be pumped to a storage stage prior to passage to a screening stage, and can be pumped in a direct (non-return) path from the pump to the screening stage. If desired or necessary, a portion of the pumped pulp can be recirculated and pumped again to ensure that sufficient energy is imparted thereto to effect latency removal.

13 Claims, 4 Drawing Figures

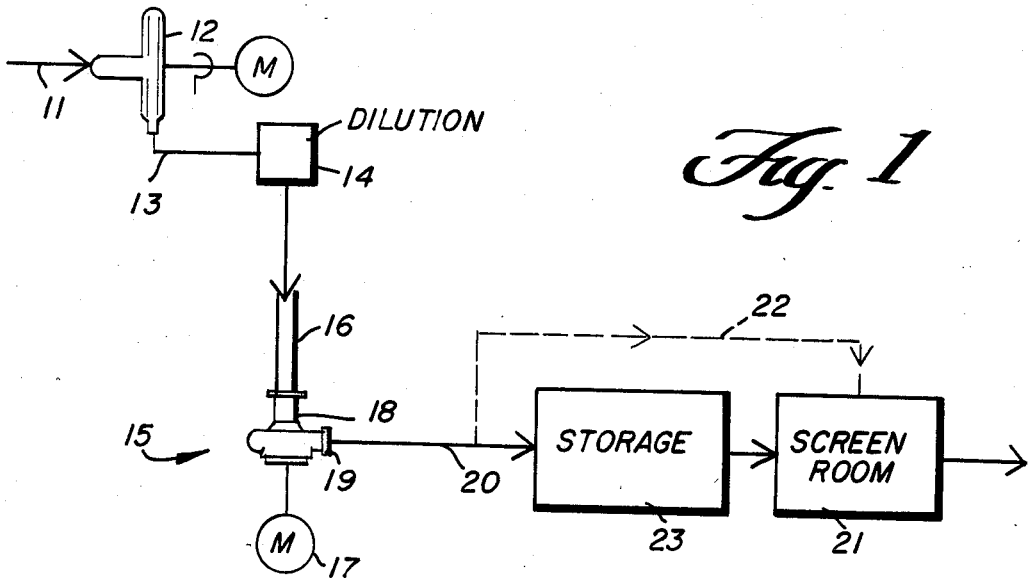
Fig. 1
Fig. 2
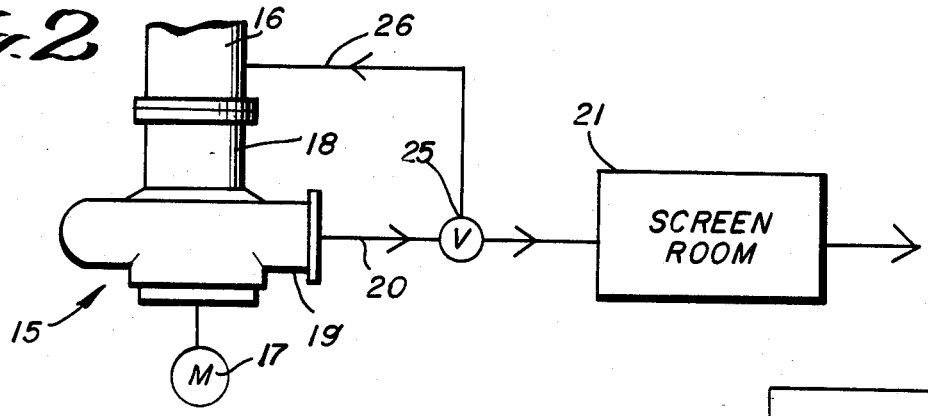
Fig. 3
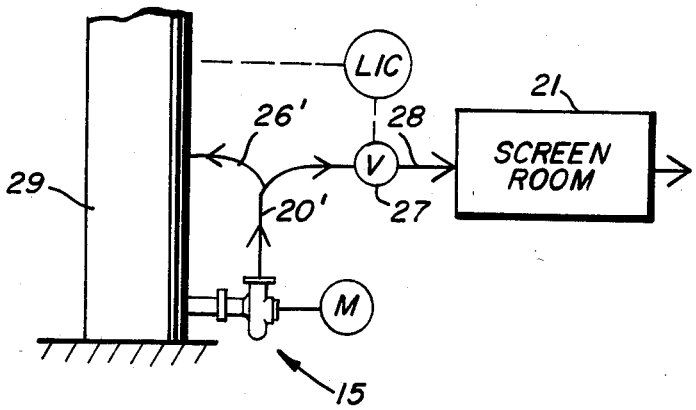
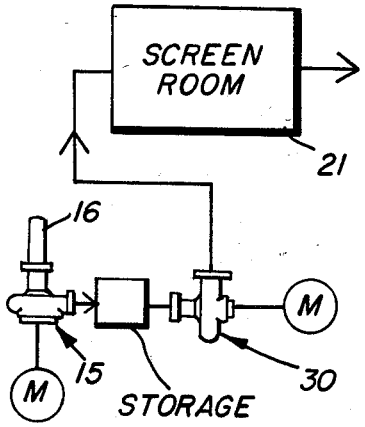
Fig. 4

METHOD OF REMOVING LATENCY FROM MEDIUM CONSISTENCY PULPS BY PUMPING THE PULP

BACKGROUND AND SUMMARY OF THE INVENTION

During the refining of comminuted cellulosic material (e.g., wood chips) to produce mechanical pulps, some of the fibers of the pulp become distorted (e.g., twisted, kinked, or curled). The pulp is then said to have "latent properties" and unless the latency is removed, it can be difficult to effectively screen the pulp and/or it is difficult to produce from the pulp paper products having desired properties.

In typical commercial practice, latency removal is effected by passing the pulp to a latency chest. In the latency chest, pulp is agitated at a consistency of about 1.25–2% in a temperature range generally between about 70° C.–90° C., for twenty or thirty minutes or more. after agitation for that period of time, the pulp is pumped to a screening room.

In another prior art proposal, as disclosed in U.S. Pat. No. 4,361,464, a predetermined sample of pulp is placed in a container, and then is pumped in a circulatory path from the container, and back to the container, by a conventional centrifugal pump. Recirculation is effected at a rate of at least five times a minute, and utilizing such a technique it is possible to effect substantially complete latency removal in three minutes, and perhaps in as little as one minute.

According to the method and apparatus of the present invention, latency removal is accomplished with a speed and simplicity vastly superior to those in the prior art. According to the present invention, latency removal can be effected without introducing any delay whatsoever in the treatment of the pulp, and without the necessity for a separate tank, agitator, or the like. Such a remarkable result is achieved according to the present invention by effecting fluidization of the pulp to effect latency removal, the fluidization being effected during pumping of the pulp from one stage to another utilizing a centrifugal pump capable of pumping pulp at a consistency of between about 8–25%, and ideally between about 12–25%. Several forms that such a pump can take are shown in U.S. Pat. Nos. 4,435,193 and 4,410,337, and Canadian Pat. No. 1,102,604.

In the practice of the present invention, it is possible to effect latency removal merely by pumping the pulp in a non-return path from a dilution stage to a screening stage. Refining typically takes place at a consistency of 25–45%, and the refined pulp is diluted to a consistency of about 8–25%, and then pumped to the screening stage. The pulp may be stored in a storage tank after pumping and just before the screening stage, and if desired in order to enhance latency removal another pump may be provided between the storage stage and the screening stage. Also where desired a portion, and only a portion, of the pumped pulp may be recirculated back to the pump inlet.

It is the primary object of the present invention to provide a method and apparatus to effect quick and simple mechanical pulp latency removal. This and other objects of the present invention will become clear from an inspection of the detailed description of the invention, and from the appended claims.

BRIEF DESCRIPTION OF THE DRAWINGS

FIG. 1 is a schematic of a first embodiment of exemplary apparatus for practicing the method according to the present invention; and FIGS. 2 through 4 are further alternative embodiments, respectively, of other forms apparatus may take for practicing the method according to the present invention.

DETAILED DESCRIPTION OF THE DRAWINGS

In the production of mechanical pulps, with reference to FIG. 1, comminuted cellulosic fibrous material, such as wood chips, is fed in line 11 to one refiner 12, or a series of such refiners. The refiner 12 turns comminuted cellulosic fibrous material into mechanical pulp, and the refiner 12 is typically operated with the material at a consistency of about 25–45%. The pulp is discharged from refiner 12 into line 13, and passes to a dilution stage 14, wherein the pulp is diluted to a medium consistency. Medium consistency pulps are still pumpable utilizing special—but commercially available—centrifugal pumps. Thus while some dilution is normally necessary, it is not necessary to dilute to the 1.25–2% consistency level necessary to utilize conventional latency chests.

After dilution of the pulp at stage 14, the pulp is subjected to fluidization. This is preferably accomplished utilizing the medium consistency pump 15, and the pulp can be passed from stage 14 to the pump 15 utilizing a simple pipe or chute 16. A typical centrifugal pump 15 utilizable in the practice of the present invention is sold under the trademark "MC" and is available from Kamyr, Inc. of Glens Falls, N.Y., and Kamyr AB of Karlstad, Sweden. Various form such a pump may take, including gas removal apparatus associated therewith, are disclosed in U.S. Pat. Nos. 4,435,193 and 4,410,337, and Canadian Pat. No. 1,102,604. The motor 17 for effecting rotation of the rotor of the pump 15 normally effects rotation of the rotor at a speed of about 1500–4000 rpm's, in order to effect fluidization of the pulp. The pulp passes into pump inlet 18, is fluidized, and passes out pump discharge 19. The energy imparted to the pulp during fluidization effects substantially complete latency removal.

The particular pump 15 chosen for the practice of the method of the invention is preferably of larger size than what would be chosen in most other systems. This is because it is desirable to ensure that high enough energy is imparted to the pulp during fluidization to effect substantially complete latency removal.

In the FIG. 1 embodiment, the pulp is pumped by pump 15 into line 20, which provides a non-return path directly to a subsequent treatment station. Typically, the subsequent treatment station would be a screening stage, such as a screen room 21. As shown by the dotted line conduit 22 in FIG. 1, the pulp may be passed directly to the screen room 21, or it may first be passed to a storage tank 23, and then to the screen room 21. Screening may also be effected at a consistency of about 8–25%. A special, but commercially available, screen equipment is utilized, such as screening apparatus sold under the trademark "MC" by Kamyr, Inc. and Kamyr AB.

In the FIG. 2 embodiment, a portion of the pulp in line 20 is diverted by conventional diverting valve 25 so that it passes into line 26 and recirculates to the inlet 18 to the pump 15. Only a portion of the pulp in the line 20 will be so diverted, and this diversion will be practiced only where, for whatever reason, a higher degree of latency removal is desired than can be provided by the particular pump 15 alone. As described above, however, by proper selection of the size of the pump 15, substantially complete latency removal can be effected utilizing only the pump 15.

The embodiment illustrated in FIG. 3 is similar to that illustrated in FIG. 2 with a few minor differences. In the FIG. 3 embodiment, the pulp from the dilution stage 14 passes into tank 29, and the pump 15 is disposed so that the axis of rotation of the rotor thereof is horizontal instead of vertical. The conduit 20' includes a branch portion 26' thereof, which diverts a portion, but only a portion, of the pulp back to the container 29. The amount of pulp that will be diverted to the recirculating branch 26' is controlled by controlling the metering valve 27 to regulate the amount of flow in branch 28 of the conduit 20'.

In the FIG. 4 embodiment, a second pump 30 is provided, substantially identical to the pump 15, for facilitating latency removal. The pump 30 is in series with the pump 15, and—as illustrated in FIG. 4—may be disposed between the storage tank 23 and the screen room 21.

It will thus be seen that according to the present invention a method and apparatus are provided for treating mechanical pulp having latent properties so as to effect substantially complete latency removal in a quick and simple manner. Virtually no delay in the pulp production and processing procedure is occasioned in order to effect latency removal, and a great deal of the equipment necessary in order to effect latency removal in the prior art is eliminated, while its function (i.e., latency removal) is not.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of treating mechanical pulps having latent properties and a consistency of about 8–25%, comprising the steps of fluidizing the pulp so as to effect substantially complete removal of the latency thereof by, and during, centrifugal pumping of the pulp having a consistency of about 8–25% from one treatment stage to another, by pumping the pulp in a non-return path.

2. A method as recited in claim 1 wherein said pumping step is further practiced by effecting simultaneous pumping and fluidization at a plurality of points along said non-return path.

3. A method of treating mechanical pulps having latent properties and a consistency of about 8–25%, comprising the steps of fluidizing the pulp so as to effect substantially complete removal of the latency thereof by, and during, cnetrifugal pumping of the pulp having a consistency of about 8–25% from one treatment stage to another, by pumping a portion of the pulp in a non-return path, while recirculating another portion, but only a portion, of the pulp in a recirculatory path to be centrifugally pumped again.

4. A method as recited in claim 3 wherein said pumping step is practiced by pumping the pulp from a refining stage to a screening stage.

5. A method as recited in claim 4 comprising the further step of between said refining stage and pumping of the pulp, diluting the pulp from refiner stage consistency to said consistency of between about 8–25%.

6. A method as recited in claim 5 comprising the further step of after pumping the pulp and before passage of the pulp to said screening stage, effecting storage of the pulp.

7. A method as recited in claim 4 comprising the further step of after pumping the pulp and before passage of the pulp to said screening stage, effecting storage of the pulp.

8. A method of treating comminuted cellulosic material to produce a mechanical pulp substantially free of latent properties, comprising the steps of:

(a) refining the comminuted cellulosic material to produce a mechanical pulp having latent properties;

(b) diluting the mechanical pulp to provide pulp having a consistency of about 8–25%; and (c) simultaneously fluidizing and pumping the pulp having a consistency of about 8–25%, to effect substantial removal of the latency of the pulp and passage of the pulp to a further treatment station by pumping the pulp in a non-return path.

9. A method as recited in claim 8 wherein step (c) is practiced by passing the pulp to a screening stage.

10. A method as recited in claim 9 wherein step (c) is practiced to pump the pulp to a storage stage prior to passage to the screening stage.

11. A method as recited in claim 8 wherein step (a) is practiced at a consistency of about 25–45%.

12. A method as recited in claim 10 comprisng the further step of effecting further simultaneous fluidization and pumping of the pulp between the storage and screening stages.

13. A method as recited in claim 8 wherein step (c) is further practiced by effecting simultaneous pumping and fluidization at a plurality of points along said non-return path.

* * * * *